United States Patent [19]

Kashio

[11] 4,095,408

[45] Jun. 20, 1978

[54] WATCH DEVICE

[75] Inventor: Toshio Kashio, Tokyo, Japan

[73] Assignee: Casio Computer Co., Ltd., Tokyo, Japan

[21] Appl. No.: 771,742

[22] Filed: Feb. 24, 1977

Related U.S. Application Data

[63] Continuation of Ser. No. 487,461, Jul. 11, 1974, abandoned.

[30] Foreign Application Priority Data

Jul. 24, 1973 Japan ..... 48-83300

[51] Int. Cl.[2] ..... G04C 3/00; G04B 19/24

[52] U.S. Cl. ..... 58/23 R; 58/58; 200/DIG. 29

[58] Field of Search ..... 58/4 A, 23 R, 50 R, 58/58, 85.5; 200/DIG. 29, 61.45, 61.52

[56] References Cited

U.S. PATENT DOCUMENTS

| | | | |
|---|---|---|---|
| 3,672,155 | 6/1972 | Bergey et al. | 58/50 R |
| 3,729,923 | 5/1973 | Brigliano et al. | 58/50 R |
| 3,750,383 | 8/1973 | Kakizawa | 58/50 R |
| 3,760,584 | 9/1973 | Dargent | 58/4 A |
| 3,823,285 | 7/1974 | Dwyer | 200/DIG. 29 |
| 3,823,550 | 7/1974 | Bergey | 58/50 R |

*Primary Examiner*—Edith S. Jackmon
*Attorney, Agent, or Firm*—Flynn & Frishauf

[57] ABSTRACT

A watch device is adapted to deliver a time counting signal from an electronic time counting means to a display means to effect a display corresponding to the time counting signal. The watch device comprises a switching means for producing an electric signal when it takes a predetermined attitude; a timer means driven, at the point of time when the signal is initiated, to produce a signal having a predetermined time width; and a display control means for effecting a display by the timer means during a time period corresponding to the predetermined time width.

3 Claims, 5 Drawing Figures

WATCH DEVICE

This is a continuation of application Ser. No. 487,461 filed July 11, 1974 which is now abandoned.

This invention relates to a watch device adapted to count time electronically and to effect a display corresponding to its time counting signal, and more particularly to a watch device capable of controlling its display period.

A watch device adapted to count time electronically to effect a display corresponding to its time counting signal, for example, effect a display of time in the form of digital values is known. The watch device comprises an electronic time counting means including an oscillator and a display means for effecting a display corresponding to a time counting signal. Where such watch device is used, for example, as a wrist watch, it is necessary to eliminate the causes of shortening the service life of a cell or battery, since the battery or cell incorporated in the watch device has a limited capacity. In this case, a power consumption can be prominently reduced both by using CMOS (complimentary metal oxide silicon) elements in the time counting circuit and by using a liquid crystal etc., as a display element, in the display means. In the case of a wrist watch, however, a further power saving is required. Even if the liquid crystal is used as the display element, a problem arises from the standpoint of the service life of the liquid crystal. To obviate such shortcomings it is known to provide a manually operable switch so that a display means can be operated only when it is desired to read time. It is very inconvenient, however, to effect such manual operation. It is also known to incorporate, for example, a mercury switch in the watch device in place of such a manually operable switch so that a time display means can be operated only when the watch device is moved to a given position to operate the mercury switch. According to this method, however, a time display is effected only during the time period in which the watch device is maintained at said given position, and the time display is rendered very unstable due to a position change involved during the reading time and due to the chattering of the switch.

It is accordingly the object of this invention to provide a watch device capable of operating, once the watch device takes a predetermined position, a display means only during a predetermined length of time irrespective of the position taken.

SUMMARY OF THE INVENTION

A watch device according to this invention comprises an electronic time counting means including an oscillator; a display means to which a time counting signal from the time counting means is supplied; a switching means for producing an electric signal when it takes a predetermined position; a timer means driven, at the point of time when the electric signal is initiated, to produce a signal having a predetermined time width; and a display control means adapted to apply a driving signal for display to the display means only during the time period corresponding to the predetermined time width to cause the display means to be driven according to the time counting signal.

According to this invention, a time display can be performed during a predetermined length of time without the necessity of holding the watch device in the predetermined position. Consequently, the time display is very stable and it is also possible to extend the service life of a cell or battery and of a display element. If the time width of the timer means is suitably selected, it is possible to effect a time display only during a time period necessary for confirmation of time.

BRIEF DESCRIPTION OF THE DRAWINGS

This invention can be more fully understood from the following detailed description when taken in conjunction with the accompanying drawings, in which.

DETAILED DESCRIPTION OF THE PREFERRED EMBODIMENT

Figure 1:
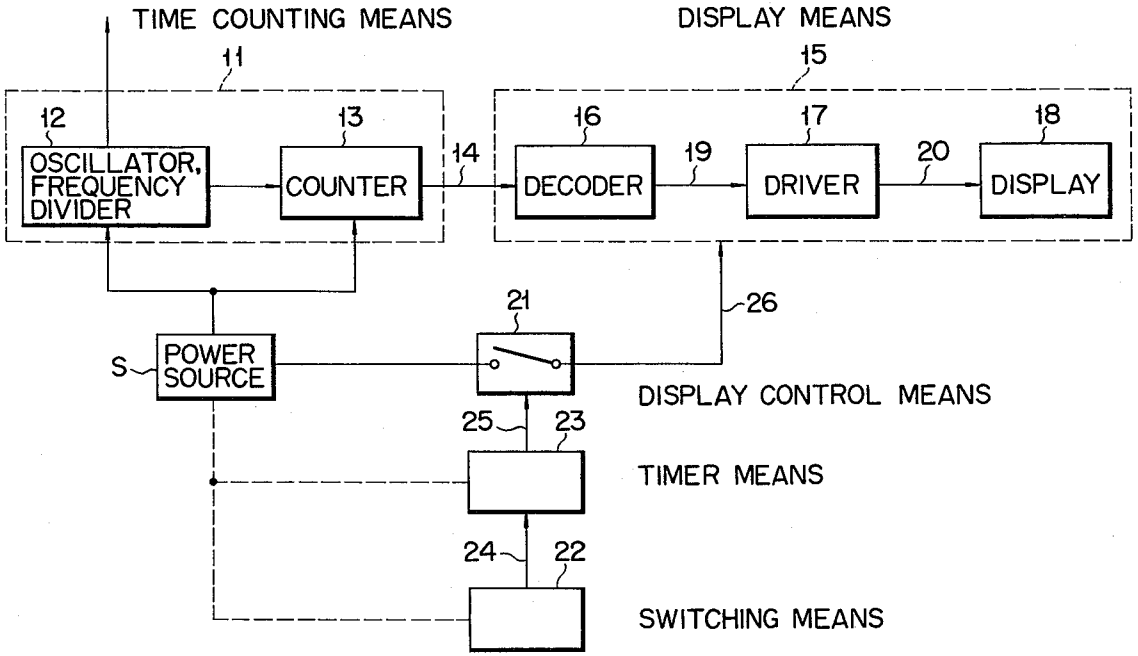
FIG. 1 is a block diagram showing one embodiment of this invention.

In FIG. 1 an electronic time counting means 11 includes a clock pulse source 12 comprising an oscillator and a frequency divider for dividing an oscillation frequency from the oscillator, and a plurality of counters for counting clock pulses from the clock pulse source. The time counting means 11 is connected to a power source S to normally generate time counting signals, for example, representing "an hour", "a minute ", "a second". The oscillator-frequency divider 12 and counter 13 are made of circuit elements, such as CMOS elements, requiring a small power consumption. A display means 15 includes a decoder 16, a driver 17 and a display element 18. The decoder 16 is adapted to decode a time counting signal 14 into a signal suitable for display and supply the decoded signal 19 to the driver. The decoding may be performed during a time period in which a display driving signal 26 (later described) is supplied to the display means 15 for decreasing power consumption in the decoder. In this case, the driving signal 26 may be supplied to the drive to inhibit the supply of the decoded signal 19 to the driver 17. In the latter case, the driving signal 26 may be supplied to the decoder to inhibit the supply of the time counting signal 14 to the decoder. The driver 17 is adapted to amplify the signal 19 and supply an amplified output signal to the display element 18. The display element 18 is made of, a liquid crystal and performs a display corresponding to the signal 14 which is converted into the signal 20, which is for example, a digital signal indicative of time. The display means 15 is driven, by a driving voltage from the power source 14, only during the time period in which a control switch 21 for example a switching transistor is closed.

There are further provided a switching means 22 and a timer means 23 which are connected to the power source S. The timer means 23 generates, upon receipt of a signal occurring at the starting time of the switching means 22, a signal 25 which is continued for a predetermined length of time. The signal 25 is supplied to the display control switch 21 (i.e., to the base of a switching transistor); to cause the latter to become conductive. When the switching transistor of switch 21 is conductive, a display driving signal 26 is delivered to the display means 15.

Figure 3:
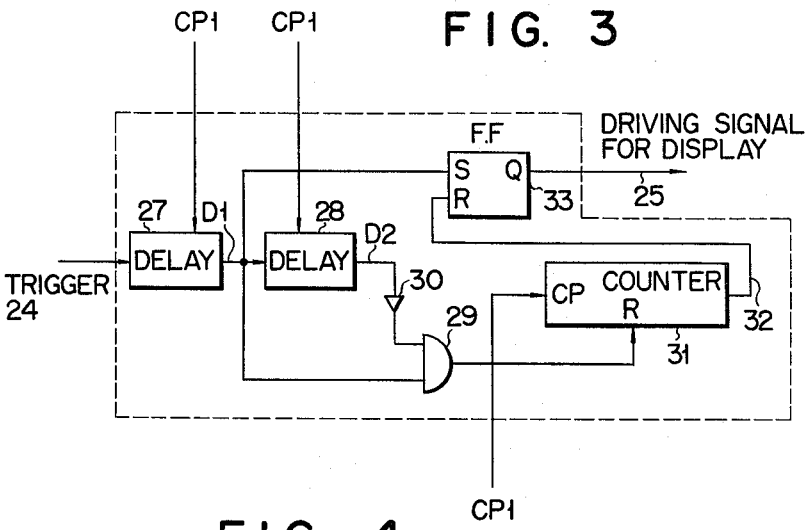
FIG. 3 is a block diagram showing one embodiment of a timer means of FIG. 1.

FIG. 3 shows one embodiment of the timer means 23. In FIG. 3, a trigger signal 24 and a clock pulse cpl from the oscillator-frequency divider 12 are supplied to a first delay circuit 27 to produce an output D1. To a second delay circuit 28, the output D1 and clock pulse cpl are supplied to produce an output D2. The signal D1 is supplied to an AND circuit 29, while at the same time the output D2 is supplied through an inverter 30 to an AND circuit 29. To a reset terminal R of a counter 31 the output of the AND circuit 29 is supplied and the clock pulse cpl is supplied to a cp terminal. The counter 31 initiates the counting of the clock pulses cpl when it is reset, and produces an output signal 32 when it counts a predetermined number of clock pulses. To a set terminal S of a flip-flop circuit 33 the signal D1 is supplied and the output signal 32 is supplied to a reset terminal of the flip-flop circuit 33. The flip-flop circuit 33 produces a set output which is continued until the flip-flop circuit 33 is reset after it is set. The clock pulse supplied to the counter 31 can also be selected to have a frequency different from the frequency of the clock pulse supplied to the respective delay circuit. The flip-flop circuit 33 is never set by a set signal supplied to the set terminal S so long as a reset signal is supplied to the reset terminal R. The output signal 32 from the counter 31 is maintained at "1" until the next reset signal is supplied thereto from the AND circuit 29. Therefore, even if the switching means 22 is still in its ON state after the elapse of the predetermined length of time, the flip-flop circuit 33 is not set by the reset signal supplied from the delay circuit 27. That is, when the switching means is cut off and then closed again an output from the AND circuit 29 is generated. When the thus generated output from AND circuit 29 is supplied to the reset terminal R of the counter 31, the signal 32 becomes "0". Thus, the flip-flop circuit 33 can then be set by the set signal supplied from the delay circuit 27.

The operation of the timer means will be explained by reference to FIG. 4.

Figure 4:
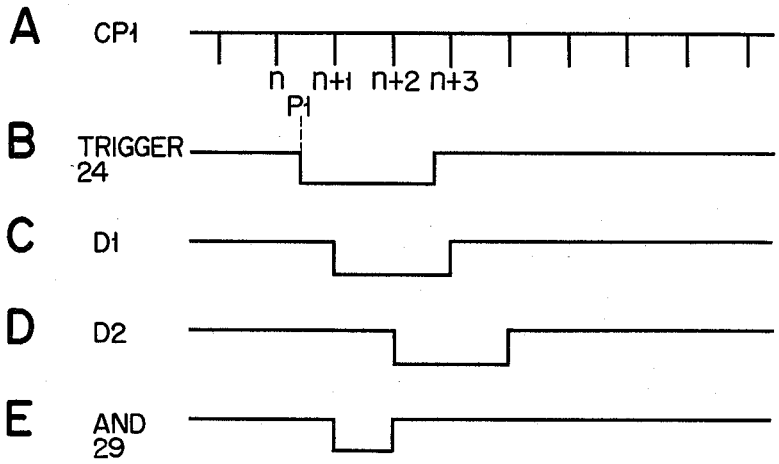
FIG. 4 is an explanatory view showing the action of a circuit arrangement of FIG. 3.

Suppose that the starting time *p*1 of a trigger signal 24 shown in FIG. 4-B is present between an *n*-th clock pulse and an $(n+1)$th clock pulse. Then, a signal D1 whose starting point is in synchronism with an $(n+1)$th clock pulse is obtained from the first delay circuit 27 (FIG. 4-C). Then a signal D2 whose starting point is in synchronism with an $(n+2)$th clock pulse is obtained from the second delay circuit 28 (FIG. 4-D). Under the action of the inverter 30 a reset pulse having a width equal to one cycle of the clock pulse cpl is obtained from the AND circuit 29 (FIG. 4-E). The flip-flop circuit 33 is set at the point of time when the signal D1 is started, and reset by a signal 32 generated at the point of time when a predetermined number of clock pulses are counted after the counter 31 is reset by the output of the AND circuit 29 and thus the reset signal. From this it will be understood that the set output 25 of the flip-flop circuit 33 is continued from the point of time when the counter 31 is reset until a predetermined maximum count is made. The display control switch 21 is held closed (i.e., conductive, during the time period in which the signal 25 is continued, to permit a display to be effected.

The timer means is not restricted to the above-mentioned embodiment. The timer means may be so constructed that upon receipt of the trigger signal 24 a pulse of predetermined width is generated to cause the counting circuit 31 and flip-flop circuit 33 to be operated in the same manner as mentioned above.

One embodiment of the switch means 22 will be explained below by reference to FIGS. 2A and 2B.

Figure 2A:
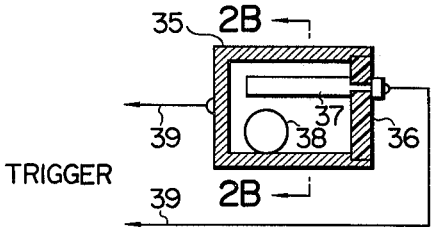
FIGS. 2A and 2B are, respectively, a side view in section and a cross sectional view taken along line 2B—2B, both showing one embodiment of a switch means of FIG. 1.
Figure 2B:
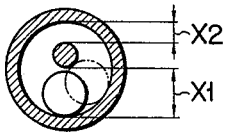

In FIGS. 2A and 2B, an electroconductive, bottomed cylinder 35 having a cylindrical space defined therein has an insulating covering 36 which is secured at the open end of the cylinder. To the covering 36 is mounted a rod-like electrode 37 displaced from the axis of the cylinder and extending inward in a parallel relation to the axis of the cylinder. As shown in FIG. 2B an electroconductive ball 38 having a diameter smaller than a maximum distance X1 between the inner surface of the cylinder and the side surface of the rod-like electrode 37, but larger than a minimum distance X2 between the inner surface of the cylinder and the side surface of the electrode is housed in the cylinder. A lead wire 39 connected to the cylinder 35 and electrode 37 delivers an electrical signal or a trigger signal 24 to the first delay circuit 27 when the rod-like electrode 37 is contacted with the inner surface of the cylinder through the electroconductive ball 38. When a watch device takes a predetermined attitude or position, for example, when its time indicating panel takes a horizontal position, the ball 38 is moved in a position indicated by a chain dot line in FIG. 2B to cause the rod-like electrode to be electrically connected to the inner surface of the cylinder. Any switch means may be used if it delivers a trigger signal 24 when the watch device takes the predetermined attitude or position. For example, a mercury switch may be used as the switch means 22.

As will be understood from FIGS. 2A and 3, when the watch device takes the predetermined attitude position for example, a position permitting time indication to be readily read, a trigger signal 24 is generated to cause the timer means 23 to be started, thereby initiating a timer indication. Once the time indication is so initiated, it is continued, only during the time period set by the timer means 23, irrespective of the position taken. Consequently, where the watch device according to this invention is removed off the user's wrist and left as it is, no time indication is effected after the lapse of the predetermined length of time.

It will be evident to those skilled in the art that the time counting means 11 is so designed as to generate a time indicating signal representing "a month", "a date of the month" or "a date of the week", in addition to a time indicating signal representing "an hour", "a minute" or "a second".

What is claimed is:

1. A wrist watch device comprising:

a source of power;

an electronic time counting means including an oscillator, said time counting means generating time counting signals;

a liquid crystal display means having a display surface, said display means being coupled to said time counting means for receiving time counting signals from said time counting means;

a switch means coupled to said source of power and including only inclination responsive means for generating an electrical signal only when said wrist watch device is brought to a given position at which the angle between its display surface and a horizontal plane is within a predetermined range;

circuit means coupled to said switch means and to said source of power to produce first and second control signals when supplied with said electrical signal from said switch means;

counter means coupled to said time counting means, to said circuit means and to said source of power for commencing to count clock pulses supplied from said time counting means when reset by said first control signal and for producing a third control signal when a predetermined number of said clock pulses is counted;

a holding circuit coupled to said counter means, to said circuit means and to said source of power to be set by said second control signal for producing a hold signal and adapted to be reset by said third control signal for stopping said hold signal; and display control means coupled to said holding circuit and to said source of power and being responsive to said hold signal to apply a display driving signal to said liquid crystal display means for causing said liquid crystal display means to be driven for the duration of said hold signal which corresponds to the time duration of a given number of said time counting signals supplied from said time counting means whereby said liquid crystal display means may be driven substantially continuously during wearing of the wrist watch and is extinguished during non-use thereof regardless of the inclination of the wrist watch during said non-use.

2. A wrist watch device according to claim 1 wherein said switch means comprises an electroconductive bottomed cylinder having a cylindrical space defined therein; an insulating covering mounted at the open end of the cylinder; a rod-like electrode mounted on said insulating covering, displaced from the axis of said cylinder and extending inwardly in a parallel relation to the axis of said cylinder; an electroconductive ball housed in said cylindrical space of said cylinder, the diameter of said ball being smaller than a maximum distance between the side surface of said rod-like electrode and that inner surface of said cylinder which is parallel to the axis of said cylinder but being greater than a minimum distance between the side surface of said rod-like electrode and the inner surface of the cylinder, said ball being adapted to permit an electrical connection to be effected between the inner surface of said cylinder and the side surface of said rod-like electrode when said wrist watch device is brought to said given position; and means coupled to said cylinder and said rod-like electrode for deriving said electrical signal when said electrical connection is effected through said electroconductive ball.

3. A wrist watch device according to claim 1 wherein said circuit means comprises a first delay circuit for producing a first pulse as said second control signal, said first pulse being continued for a length of time corresponding to an integral multiple of one cycle of the clock pulse when said electrical signal is supplied thereto and being started in synchronism with a pulse of said clock pulse; a second delay circuit coupled to said first delay circuit for producing a second pulse delayed from said first pulse at least one cycle of the clock pulse; gate means coupled to receive said first pulse and the inverted pulse of said second pulse to produce a third pulse as said first control signal having a width corresponding to an integral multiple of one cycle of the clock pulses.

* * * * *